United States Patent [19]

Branković

[11] 4,444,393

[45] Apr. 24, 1984

[54] BOX FOR PARTY GAMES

[76] Inventor: Miodrag Branković, Svetozara Markovi/ a 38/III, 11000 Beograd, Yugoslavia

[21] Appl. No.: 358,303

[22] Filed: Mar. 15, 1982

[51] Int. Cl.[3] ..... A63F 7/26

[52] U.S. Cl. ..... 273/85 D; 273/119 A; 273/239; 273/284

[58] Field of Search ..... 273/1 M, 1 GB, 1 GD, 273/85 A, 85 B, 85 C, 85 D, 85 F, 239, 126 A, 85 R, 118 A, 119 A; 46/240

[56] References Cited

U.S. PATENT DOCUMENTS 3,045,393 7/1962 Knott ..... 273/85 R 3,085,802 4/1963 Yarashes ..... 273/118 A

*Primary Examiner*—Richard C. Pinkham

*Assistant Examiner*—Matthew L. Schneider

*Attorney, Agent, or Firm*—Armstrong, Nikaido, Marmelstein & Kubovcik

[57] ABSTRACT

A box for party games which permits many different games to be played thereon. A rectangular frame supports a flat surface a small distance down from its top. Replaceable sheets, each bearing indicia of a different game, can be positioned on the flat surface. Tubes which are rotatable and longitudinally movable extend into the box from opposite sides in an alternating array. Each tube carries two or more equi-spaced permanent magnets arranged in parallel with respect to a plane passing through the axis of the tube. The same magnetic poles of the magnets on a particular tube point in the same direction. Two embodiments of supporting structure for the tubes are disclosed. Rotation and reciprocation of the tubes enables the control and movement of a megnetic playing piece about the surface of a replaceable sheet.

3 Claims, 4 Drawing Figures

BOX FOR PARTY GAMES

BACKGROUND OF THE INVENTION

The present invention relates to a box for party games. An object of the invention is to make possible the playing of different games using a single box, by simply changing drawings, pictures or relief sheets on the top surface of the box. These drawings, pictures and reliefs represent different sport grounds or different games such as: "ice hockey", "cricket", "who'll first", "who'll more", "bowling", "roulette of skill", "labyrinth", "hurdle racing", "war games" and so on.

The main defect of the existing mechanical constructions of different games is the impossibility of playing more than one game with one construction. The technical problem of how to make possible playing different games with a single device is solved by the construction of this box.

SUMMARY OF THE INVENTION

The present invention is a box for party games that consists of rectangular frame, a smooth horizontal top surface with a low edge all around, comprising a construction enabling the motion of a small magnet chip accross the top box surface, using this motion for playing different party games by simple change of drawings, pictures or relief sheets and accessories on top surface of the box, said construction consisting of a number of round tubes made of nonmagnetic material, each one carrying on its surface or inside itself two or more little permanent magnets disposed at the equal distances from each other and paralelly arranged in the same place passing through the axis of the tube, the same magnet poles on a tube pointing to the same direction, the tubes being mounted inside the box very near the top surface in such a way that they are alternately stretching out from the left or right box side through the round holes.

DETAILED DESCRIPTION OF PREFERRED EMBODIMENTS

Figure 1:
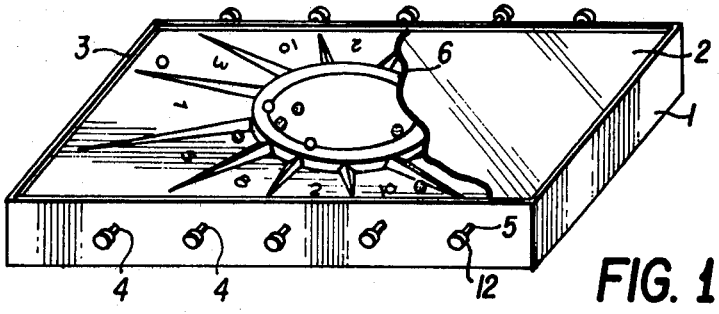
FIG. 1 is a perspective view of the present invention.
Figure 2:
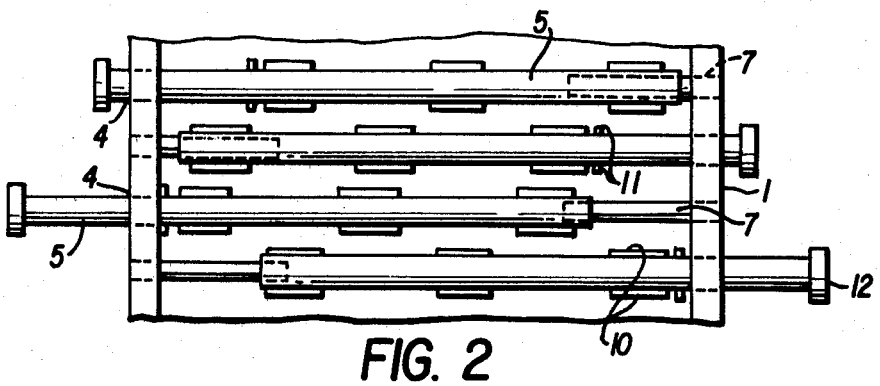
FIG. 2 is a partial bottom view of a first embodiment.

The box consists of a rectangular frame 1, with a smooth horizontal surface 2 having all around a low edge or rim 3 that holds in place changeable drawings and relief sheets 6 and prevents dropping out of jettons, magnetic chips and other accessories needed for individual games. There are several round holes 4 on lateral sides of the box. Through the holes, alternately at the left and right side, pass round tubes 5 which are carriers of permanent magnets 10. There is an equal number of tubes 5 on each side of the box. Each tube 5 has two freedoms of motion: unlimited rotation in both directions and axial motion limited by a limit stop 11. Each tube has at least two bearings. Two solutions or embodiments of these bearings are foreseen:

(a) Outer bearings at one side and inner bearings at the other side. The round hole 4 serves as an outer bearing in one side of the frame, and a round tube or rod 7 serves as an inner bearing stretching out from the opposite inner side of the frame and entering into the tube 5 up to the depth indispensable for the axial motion of the tube 5 (FIG. 2);

(b) Two outer bearings, one at each side: the round hole 4 at the one side, and a round hole 8 through an inner rib 9 that can serve in the same time for stiffening of the upper surface 2.

Figure 3:
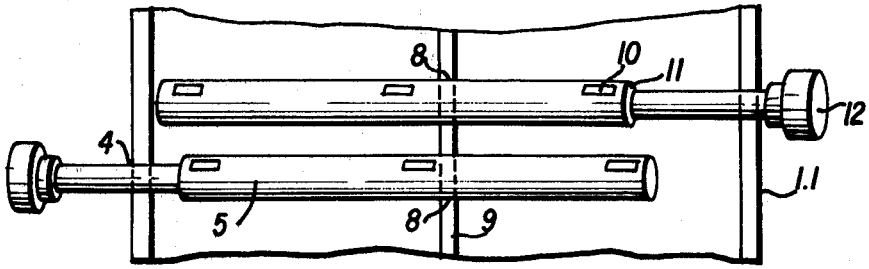
FIG. 3 is a partial top view of the bottom half of a second embodiment.

There can be several ribs if the size of the box demands it. (FIG. 3). In the solution (a) the tube which is a carrier of the magnets, is of a smaller diameter and the magnets 10 are fixed on the outer surface of the tube. In the solution (b) the tube must be of bigger diameter and the magnets are placed inside the tube so that they do not extend out of the tube and do not hinder the motion of the tube inside the bearing 8.

Figure 4:
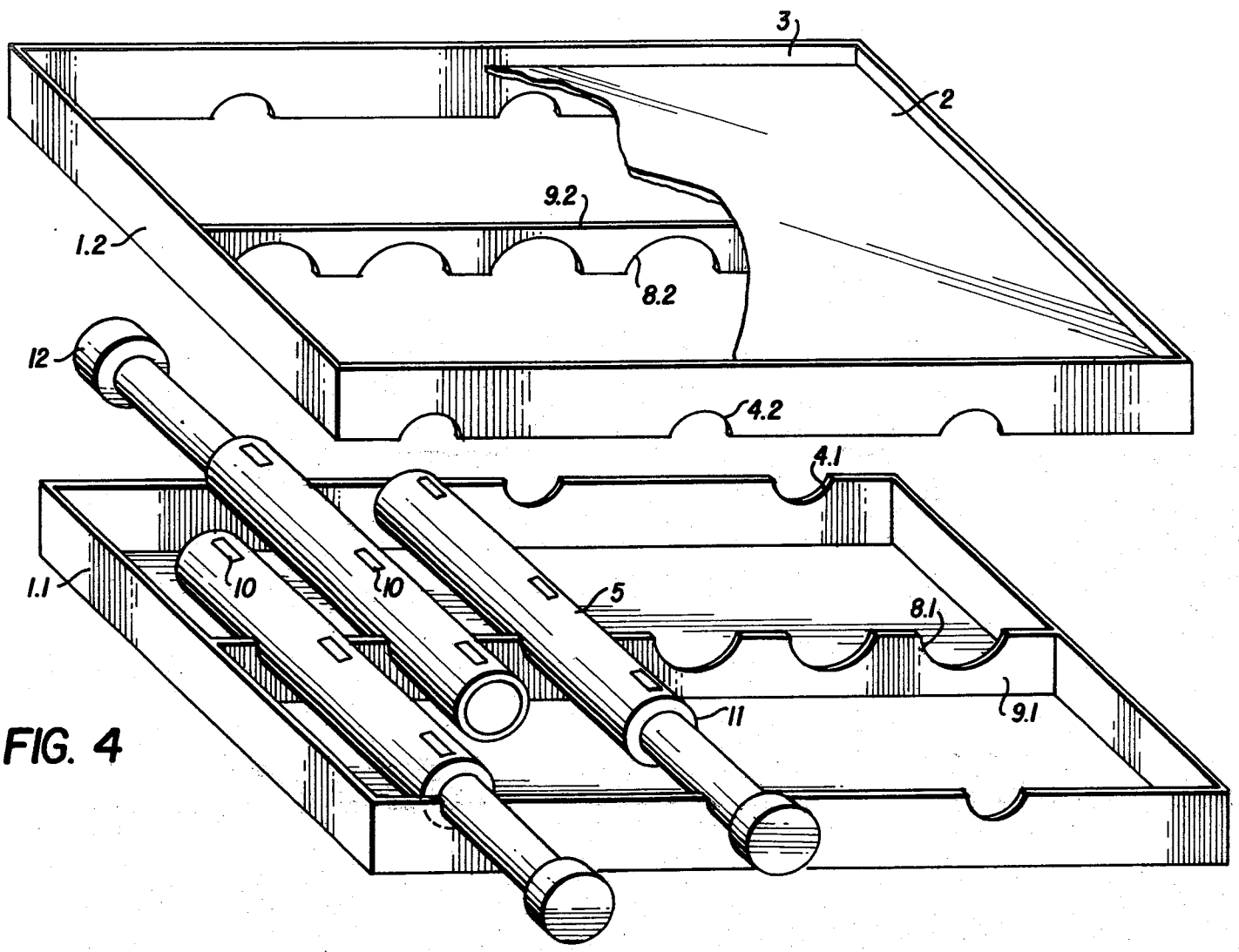
FIG. 4 is an exploded perspective view of the second embodiment.

For a simpler production of solution (b), the box can be produced in two parts obtained by a horizontal section of the box frame and the stiffening rib (ribs) exactly along the horizontal diameters of the holes (FIG. 4), so that the rectangular frame 1 would be assembled from two parts 1.1 and 1.2, having the round holes 4 on the box sides from two parts 4.1 and 4.2, inner rib (ribs) 9 from two parts 9.1 and 9.2, as well as the round holes 8 through the inner rib (ribs) also from two parts 8.1 to 8.2.

Each tube has a limit stop 11 limiting the axial motion, that allows the tube 5 to be pulled out only as far as necessary to put within range of magnets 10 the whole width of the "ground" 6, and by use of all the tubes the whole surface of the "ground" 6. Each tube 5, carrier of magnets, ends outside by a button 12 for easier handling. Tubes 5 are so situated that one player handles all tubes stretching out from one side of the box, and the other player, the opposite tubes.

On (or inside) each tube 5 are fixed two or more small permanent magnets 10. On each tube 5, magnets 10 are disposed at the equal distances from each other and are parallelly arranged in the same plane passing through the axis of the tube. The same magnet poles of all magnets on a tube 5 are oriented to the same direction, so that the rotation of the tube brings under the smooth surface 2 either the magnet poles that will attract or the magnet poles that will repulse the magnetic chip that moves in such a way accross the smooth upper surface 2 or "ground" 6.

The magnetic chip, in connection with other accessories and corresponding drawing or relief of the 2 "ground", represents in one game the ball, in another "the player", in a third one a jetton of the "roulette" and so on. The relief 6 shown on the FIG. 1 is only an example for many different games.

For the sake of a quick and easy assembling of the box an alternative construction can be employed. Instead of two short magnets a longer magnet the length of which is almost equal to the diameter of the tube 5 can be fitted perpendicularly in a single movement into the tube 5, which will provide immediately two different magnet poles on the opposite sides of the tube diameter.

What is claimed is:

1. A box for party games comprising:

a rectangular frame having opposite parallel ends, parallel sides, and a top;

a flat surface fixed in said frame perpendicular to said ends and sides at a position below said top defining an edge rim;

replaceable sheets bearing indicia of various games insertable onto said flat surface below said top;

a plurality of non-magnetic, round tubes mounted in said frame close to said flat surface and extending through said sides in parallel with said flat surface, one half of said plurality extending through one side, the other half extending through the opposite in an alternating array;

means in said frame for supporting each of said plurality of tubes for unlimited clockwise and counter clockwise rotation and for reciprocation;

means on each of said tubes for limiting the amount of reciprocation; and two or more permanent magnets carried by each of said tubes, said magnets being disposed with regard to a particular tube at equal distances from each other and parallelly with respect to a plane passing through the axis of the tube, the same magnetic poles of the magnets on a particular tube pointing in the same direction.

2. The box according to claim 1, wherein said sides have a plurality of holes therein corresponding in number to plurality of tubes; each tube has an axial bore in its end inside the frame; and said means for supporting comprises said holes in said sides and a plurality of rods each opposite one of said sides, each rod being slideably fitted into one of said bores, each of said holes being sized to permit sliding and rotating of its associated tube.

3. The box according to claim 1, wherein said sides have a plurality of holes therein corresponding in number to the plurality of tubes; and said means for supporting comprises said holes in said sides and at least one rib extending between said opposite ends in parallel with said sides, said at least one rib having a plurality of bearing openings therein corresponding in number to the plurality of tubes, each of said bearing openings and said holes being sized to permit sliding and rotating of its associated tube.

* * * * *